US005261742A

United States Patent [19]

Lockhart

[11] Patent Number: 5,261,742

[45] Date of Patent: Nov. 16, 1993

[54] AIR-POWERED APPARATUS AND METHOD FOR MIXING A LIQUEFIED SAMPLE AND WEIGHING THE SAMPLE

[75] Inventor: R. Scott Lockhart, Webster, N.Y.

[73] Assignee: Eastman Kodak Company, Rochester, N.Y.

[21] Appl. No.: 21,402

[22] Filed: Feb. 23, 1993

[51] Int. Cl.[5] ..... B01F 13/08

[52] U.S. Cl. ..... 366/141; 177/245; 366/273

[58] Field of Search ..... 366/141, 142, 273, 274, 366/18; 177/245, 246

[56] References Cited

U.S. PATENT DOCUMENTS

| | | | |
|---|---|---|---|
| 2,466,468 | 4/1949 | Neal . | |
| 3,171,636 | 3/1965 | Barlow | 177/245 |
| 3,211,433 | 10/1965 | Chrostowski et al. . | |
| 3,336,006 | 8/1967 | Berg | 366/141 |
| 3,744,764 | 7/1973 | Sedam . | |
| 4,568,195 | 2/1986 | Herz | 366/274 |
| 4,725,149 | 2/1988 | Kawakami et al. | 366/141 |
| 4,991,973 | 2/1991 | Maaz et al. | 366/141 |

*Primary Examiner*—Robert W. Jenkins
*Attorney, Agent, or Firm*—Clyde E. Bailey

[57] ABSTRACT

An apparatus and method for mixing a liquefied sample and weighing the sample are provided. The method includes providing a balance for weighing the sample, removably mounting a magnetic mixer having a drive mechanism on the balance, mounting a holder on the magnetic mixer, placing a sample container containing the liquefied sample and a magnet capable of clockwise and counterclockwise rotation under influence of the drive means on the holder, operating the drive mechanism and rotating the magnet thereby mixing the liquefied sample, and weighing the liquefied sample. The power source of an air-powered balance mixer is connected such that any external noise is isolated when the mixer is not in use. Air flow from a pressurized air source is channeled through a nozzle and collected by the intake port of the air mixer. The nozzle drives the mixer without actually touching the mixer or the balance. An air gap exists between the mixer and air nozzle so that when the mixer is turned off the mixer has no effect on the weighing results.

19 Claims, 2 Drawing Sheets

AIR-POWERED APPARATUS AND METHOD FOR MIXING A LIQUEFIED SAMPLE AND WEIGHING THE SAMPLE

FIELD OF THE INVENTION

This invention relates generally to an apparatus and method for mixing a sample and weighing the sample, and, more particularly, to an electronic balance with an air driven magnetic mixer.

BACKGROUND OF THE INVENTION

An emulsion is a system typically having a liquid dispersed in an immiscible liquid. Dividing a sample of liquefied emulsion by mass requires transferring, by pumping for example, the emulsion from its container to an empty container located on an electronic balance or other similar balance or measuring device. This transfer operation can take several minutes to complete, during which time the emulsion may not be properly agitated. If an emulsion sits idle, or is without proper agitation during long transfers, heavy particles in the emulsion may settle. Settling destroys the homogeneity of the emulsion system causing erroneous measurements in coating experiments.

One method for avoiding erroneous readings due to lack of proper agitation is temporarily removing the container from the balance during the transfer operation and during mixing so that the emulsion is on the balance for a final weight reading. This method is not very practical because weighings of the emulsion throughout the transfer operation are often needed and desired more often than not. These readings are very useful for providing feedback for an automated delivery system. It is therefore impractical to move the tared container back and forth between the balance and a nearby mixer. Ideally, an emulsion is continuously stirred or mixed as long as it sits on the balance. Mixing should be interrupted to allow the balance to stabilize for intermediate weighings and resumed afterwards to minimize settling.

Unfortunately, most mixers used on or with a balance can add a source of unnecessary vibrational noise to the electronic balance readings. A propeller-type stirrer, such as disclosed in U.S. Pat. No. 4,725,149, can be cantilevered over the balance (i.e. positioned over the container) to effectively mix emulsions when the emulsions are not being weighed. Because the prop touches the fluid during weighings, the prop will transfer vibrational noise to the balance even when it is stopped. If the prop is temporarily raised above the container during weighings to prevent touching, a second problem arises. The second problem is that small amounts of the sample to be weighed are retained on the prop which significantly degrades the weighing results.

Another mixing method uses a stirring mechanism which stays with the container before, during and after the weighings. Magnetic stirrers are one example of such a mechanism. Typically, magnetic motors mounted under a container drive a magnetic stir bar placed inside the container by creating a rotating magnetic field that penetrates the container. Magnetic stirrers are ideal for most laboratory mixing applications. They are inexpensive and easily cleaned and usually stay with the sample until it is dumped. Unfortunately, a magnetic stirrer mechanism usually requires some sort of connection to an external power source. Whether driven by air, water or electricity, a tube or wire connected to an external power source is usually required. This connection, regardless of how light-weight or how carefully supported, adversely affects the stability and accuracy of precision balances.

U.S. Pat. No. 4,725,149 discloses an automatic dissolving device for dyes utilizing an electronic balance and a magnet-type stirring device mounted on the balance. U.S. Pat. Nos. 3,744,764; 3,211,433 and 2,466,468 disclose stirring devices that are fluid driven. U.S. Pat. No. 4,991,973 discloses a device for simultaneously agitating and weighing a sample wherein an electronic balance has a magnetic stirring means mounted which enables the agitating and weighing operations to be performed simultaneously and by the same device. In each of these prior art devices, however, the stirring means is integral to the balance; that is, the mixer cannot be easily removed and transported without making the balance inoperative. Accordingly, it will be appreciated that it would be highly desirable to have a simple apparatus for weighing and stirring a sample wherein the mixer is simply connected to the balance.

It is desirable to have a small, light-weight mixer that does not use interfering wires or tubing. Battery operated stirrers are a consideration but are not practical for precision balances because precision balances often lack the range to support the weight of a battery and electromagnet.

SUMMARY OF THE INVENTION

The present invention is directed to overcoming one or more of the problems set forth above. Briefly summarized, according to one aspect of the present invention, an apparatus for mixing a liquefied sample and weighing the sample comprises a balance for weighing the sample, a magnetic mixer having a drive means and being removably mounted on the balance, and a holder mounted on the magnetic mixer for receiving a sample container containing the liquefied sample and a magnet capable of clockwise and counterclockwise rotation in the sample container under influence of the drive means.

The power source of an air-powered balance mixer is connected such that any external noise is isolated when the mixer is not in use. Air flow from a pressurized air source is channeled through a nozzle and collected by the intake port of the air mixer. The nozzle drives the mixer without actually touching the mixer or the balance. An air gap exists between the mixer and air nozzle so that when the mixer is turned off the mixer has no effect on the weighing results. The mixer will not interfere with the normal precision of the balance when the balance mounted mixer is not in use. The light-weight mixing motor will not significantly limit the working range of the balance.

According to another aspect of the invention, an apparatus for mixing a liquefied sample and weighing the sample comprises an electronic balance having a frame and a balance plate mounted on the frame, a magnetic mixer having a drive means and being positionable on the balance plate, a sample container positionable on the magnetic mixer containing the liquefied sample and a magnet capable of clockwise and counterclockwise rotation in the sample container under influence of the drive means, and means for operating the drive means for effecting clockwise and counterclockwise rotation of the magnet.

Air flow powers the magnetic mixer in a manner that minimizes interference with electronic balance readings. The mixer being operated with air can be made to rotate in both directions, clockwise and counterclockwise, which is useful for stopping fluid flow quickly to minimize settling time, and for creating a shake-style mixing.

According to another aspect of the invention, a method for mixing a liquefied sample and weighing the sample comprising the steps of providing a balance for weighing the sample, removably mounting on the balance a magnetic mixer having a drive means, mounting a holder on the magnetic mixer, placing on the holder a sample container containing the liquefied sample and a magnet capable of clockwise and counterclockwise rotation under influence of the drive means, operating the drive means and rotating the magnet thereby mixing the liquefied sample, and weighing the liquefied sample.

An advantage of the present invention is that the mountable mixer obviates the need for a dedicated precision balance when mixing is not required. Thus, the mixer element of the invention can be transported and adapted to just about any precision balance , and the combination can be made to operate as a mixer/stirrer unit.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
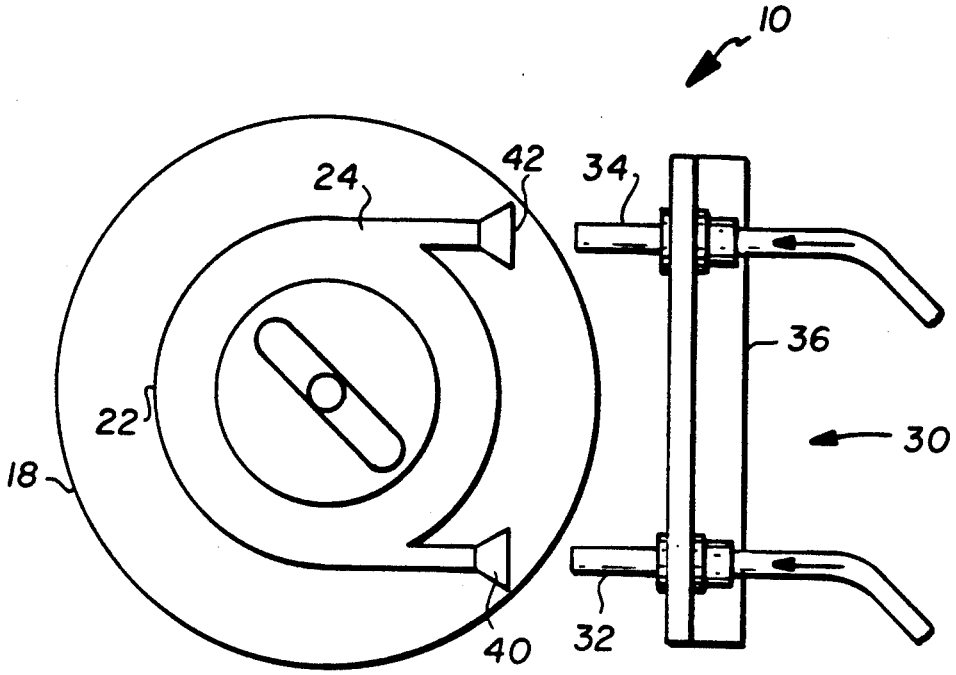
FIG. 1 is a diagrammatic top view of a preferred embodiment of an electronic balance and magnetic mixer according to the present invention.
Figure 2:
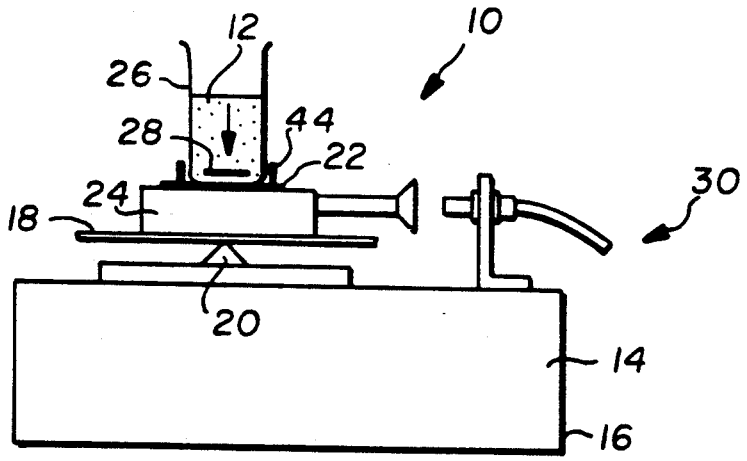
FIG. 2 is a front view of the electronic balance and magnetic mixer of FIG. 1.

Referring to FIGS. 1 and 2, an apparatus 10 for mixing a liquefied sample 12 while weighing the sample 12 includes an electronic balance 14 which actually weighs the sample 12. The electronic balance 14 has a case or frame 16 and a balance plate 18 mounted on a support post 20. A magnetic mixer 22 is fastened on the balance plate 18 and has a drive means 24. A sample container 26 is positioned on the magnetic mixer 22 and contains the liquefied sample 12 and a magnet 28 that is capable of clockwise and counterclockwise rotation in the sample container 26 under the influence of the drive means 24. Means 30 are provided for operating the drive means 24 for effecting the clockwise and counterclockwise rotation of the magnet 28 in the sample container 26. A holder 44 is preferably mounted on the mixer 22 to hold the container 26.

The means 30 for operating the drive means 24 is separated from the drive means 24 by a preselected distance and is free of mechanical connection to thereby remain free of interference with the balance plate 18. An air gap is created between the means 30 for operating the drive means 24 and the drive means 24. The means 30 for operating the drive means 24 preferably includes a first air nozzle 32 and a second air nozzle 34. The first air nozzle 32 provides a first burst of air to the drive means 24 to rotate the magnet 28 in the clockwise direction, while the second air nozzle 34 provides a second burst of air to the drive means 24 to rotate the magnet 28 in the counterclockwise direction. The clockwise rotation of the magnet 28 stirs the sample 12 and the counterclockwise rotation of the magnet 28 stops the rotation to quickly stabilize the sample 12 for accurate weighing. The air nozzles 32, 34 are preferably mounted on a bracket 36 that may be conveniently mounted on the frame 16 of the electronic balance 14. Communication between the first and second nozzles 32, 34 and the drive means is via first and second mixer input ports 40, 42, respectively.

Figure 3:
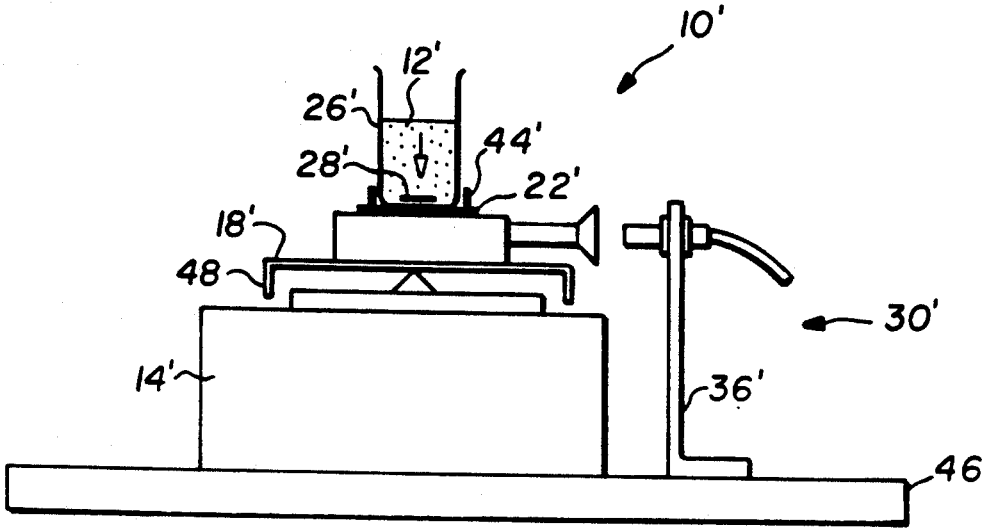
FIG. 3 is a front view similar to FIG. 2, but illustrating another preferred embodiment.

Referring to FIG. 3, the electronic balance 14' sits on a work bench or table 46, and the air nozzle assembly 30' is attached to the table 46 instead of the frame 16' of the electronic balance 14'. A magnetic shield 48 is also provided for shielding the electronic balance 14' from magnetic fields generated by the magnet 28' and magnetic mixer 22'.

Referring to FIGS. 1–3, the noncontact magnetic mixer 22 for an electronic balance 14 is constructed by fixing the balance plate 18 to its center support post 20 to prevent any rotation during mixing. The air powered magnetic mixer 22 is mounted on the balance plate 18 with the air ports 40, 42 facing out to the side of the electronic balance 14. A holder 44 is mounted on top of the mixer 22 to help center the container 26 containing the sample 12 to be weighed. One, and preferably two, nozzles 32, 34 are mounted on either the frame 16 of the balance 14 or the table 46 near the side of the balance 14. The nozzles 32, 34 are directed into, but do not touch, the mixer input ports 40, 42. The frame 36 facilitates plumbing of the air nozzles 32, 34 to allow air supplied to them to be easily turned on and off either manually or automatically.

The resulting air-powered mixer provides adequate mixing for most low to-medium viscosity fluids. The speed of the mixer can be adjusted with a needle valve to control the flow of air to the nozzles. During the weighings, the air supply must be turned off to allow the air and fluid to settle. A short settling time of about 10 to 15 seconds is usually required before stable readings can be obtained. To minimize this time, a burst of air from the second nozzle 34 can be used. This burst of air will rotate the magnet 28 in the counterclockwise direction and will quickly stop fluid flow in the container 26 and minimize any resulting vibration. The two nozzles 32, 34 may also be used to create a shake-style mixing by alternating operating first one nozzle and then the other nozzle. Air solenoids are ideal for turning the air supply on and off.

Figure 4:
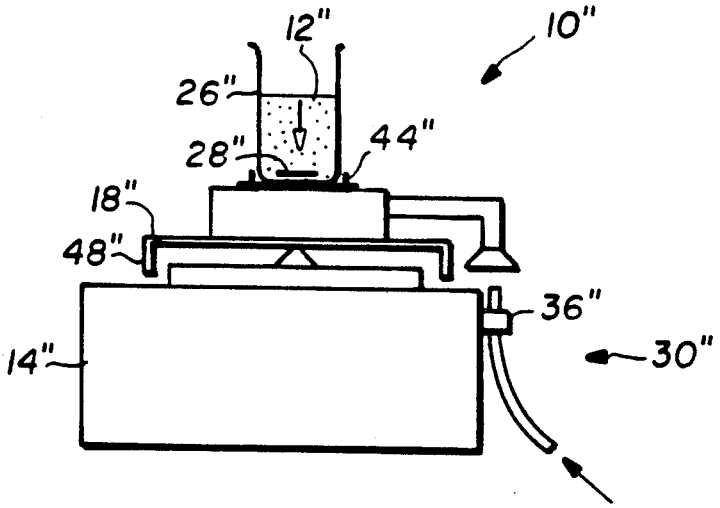
FIG. 4 is a front view similar to FIGS. 2 and 3, but illustrating another preferred embodiment.

Referring to FIG. 4, the electronic balance 14'' has a frame 16'' and a balance plate 18'' mounted on a support post 20''. The air nozzle assembly 30'' is attached to the frame 16'' of the electronic balance 14''. A magnetic shield 48'' shields the electronic balance 14'' from magnetic fields generated by the magnet 28'' and magnetic mixer 22''. The noncontact magnetic mixer 22'' for an electronic balance 14'' is constructed by simply positioning the balance plate 18'' to its center support post 20''. The air powered magnetic mixer 22'' is mounted on the balance plate 18'' with the air ports 40'', 42'' facing upward toward the sample container 26'' or downward toward the electronic balance 14''. By this construction, there is no sideways directed air and therefore no tendency for the balance plate to rotate; so, the balance plate 18" is simply mounted without being fixed to its post. The air stream is internally redirected to produce the necessary rotating force. This simplified mounting makes the mixer even more portable.

Operation of the present invention is believed to be apparent from the foregoing description and drawings, but a few words will be added for emphasis. After assembly, the sample 12 to be mixed and measured is introduced into the container 26 and the air supply is turned on and directed via nozzle 32 to the first input port 40. The flow of air causes the magnetic mixer 22 to rotate the magnet 28 thereby stirring the sample 12 as it is introduced into the container 26. After introduction of the sample 12 into the container 26, the air flow from nozzle 32 is stopped and air flow from nozzle 34 to the second input port 42 is begun. Air from nozzle 34 causes the magnet 28 to rotate in the opposite direction which quickly stabilizes the sample 12. The air flow is stopped and the weight reading is taken.

It can now be appreciated that there has been presented an apparatus and method for mixing a sample and weighing the sample. The apparatus includes a balance for weighing the sample, a magnetic mixer having a drive means and being removably mounted on the balance, and a holder mounted on the magnetic mixer for receiving a sample container containing the liquefied sample and a magnet capable of clockwise and counterclockwise rotation in the sample container under influence of the drive means. A first air nozzle provides a burst of air to the drive means to rotate the magnet in the clockwise direction prior to weighing the liquefied sample. A second air jet provides a burst of air to the drive means to rotate the magnet in the counterclockwise direction before weighing the liquefied sample to stabilize the liquefied sample.

The electronic balance has a frame and a balance plate mounted on the frame. The magnetic mixer is positionable on the balance plate and the sample container is positionable on the magnetic mixer. The air jets for operating the drive means are separated from the drive means by a preselected distance and free of mechanical connection thereto to thereby remain free of interference with the balance plate. The magnetic shield protects the electronic balance from magnetic fields generated by the magnetic mixer for more accurate readings.

The method for mixing a liquefied sample and weighing the sample, comprises providing a balance for weighing the sample, removably mounting a magnetic mixer on the balance, mounting a holder on the magnetic mixer, placing a sample container on the holder, operating the drive means and rotating the magnet thereby mixing the liquefied sample, and weighing the liquefied sample. The step of operating the drive means includes providing a first flow of air to the drive means to rotate the magnet in the clockwise direction, controlling the first flow of air to the drive means, stopping the first flow of air to the drive means before weighing the sample, providing a second flow of air to the drive means before weighing the liquefied sample to rotate the magnet in the counterclockwise direction to quickly stabilize the liquefied sample.

It can also appreciated that the present invention is simple; it uses air power and a simple combination of a magnetic stirrer, valves and nozzles. It allows for almost uninterrupted mixing of low-to-medium viscosity fluids. It is especially useful for fluids that require constant agitation and periodic weighing during transfer. It is ideal for magnetic stirrers which are the preferred mixing devices for many laboratories.

While the invention has been described with particular reference to a preferred embodiment, it will be understood by those skilled in the art that various changes may be made and equivalents may be substituted for elements of the preferred embodiment without departing from invention. Although magnetic stirring is preferred, other techniques of air-powered, non-contact mixing could be used, such as bottom mounted blender-style propellers, overhead propellers mounted on the sample container, or rotating containers and/or balance plates, for example. While magnetic stirring is clean and simple, stir bar magnets and magnetic mixers can cause magnetic noise when mounted on electronic balances, but a magnetic shield, as disclosed in U.S. Pat. Nos. 4,878,552 and 4,839,293, solves the magnetic noise problem. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. For example, the mixer input ports are illustrated as cone-shaped openings, but other shapes will also operate effectively. It is accordingly intended that the claims shall cover all such modifications and applications as do not depart from the true spirit and scope of the invention.

What is claimed is:

1. An apparatus for mixing a liquefied sample and weighing said sample, comprising:

a balance for weighing said sample;

a magnetic mixer removably mounted on said balance said magnetic mixer having a drive means; and a holder mounted on said magnetic mixer for receiving a sample container, said sample container containing said liquefied sample and a magnet capable of clockwise and counterclockwise rotation in said sample container under influence of said drive means.

2. An apparatus, as set forth in claim 1, including means for providing a burst of air to said drive means to rotate said magnet in said clockwise direction prior to weighing said liquefied sample.

3. An apparatus, as set forth in claim 1, including means for providing a burst of air to said drive means to rotate said magnet in said counterclockwise direction before weighing said liquefied sample to stabilize said liquefied sample.

4. An apparatus as set forth in claim 1, including means for providing a first flow of air to said drive means and rotating said magnet in said clockwise direction and stopping said first flow of air to said drive means before weighing said sample.

5. An apparatus, as set forth in claim 4, including means for providing a second flow of air to said drive means and rotating said magnet in said counterclockwise direction and stabilizing said liquefied sample before weighing said liquefied sample.

6. An apparatus, as set forth in claim 1, including means for providing a flow of air to said drive means and rotating said magnet, said means for providing a flow of air to said drive means being spaced from said drive means by an air gap so that said drive means is free of mechanical connection thereto to thereby remain free of interference with said balance.

7. An apparatus for mixing a liquefied sample and weighing said sample, comprising:

an electronic balance for weighing said sample, said electronic balance having a frame and a balance plate mounted on said frame;

a magnetic mixer positionable on said balance plate, said magnetic mixer having a drive means;

a sample container positionable on said magnetic mixer, said sample container containing said liquefied sample and a magnet capable of clockwise and counterclockwise rotation in said sample container under influence of said drive means; and means for operating said drive means for effecting clockwise and counterclockwise rotation of said magnet.

8. An apparatus, as set forth in claim 7, wherein said means for operating said drive means is separated from said drive means by an air gap.

9. An apparatus, as set forth in claim 7, wherein said means for operating said drive means is separated from said drive means by an air gap and free of mechanical connection thereto to thereby remain free of interference with said balance plate.

10. An apparatus, as set forth in claim 7, wherein said means for operating said drive means includes an air nozzle for providing a burst of air to said drive means to rotate said magnet in said clockwise direction prior to weighing said liquefied sample.

11. An apparatus, as set forth in claim 7, wherein said means for operating said drive means includes an air nozzle for providing a burst of air to said drive means to rotate said magnet in said counterclockwise direction before weighing said liquefied sample to stabilize said liquefied sample.

12. An apparatus, as set forth in claim 7, wherein said means for operating said drive means includes a first air nozzle for providing a first flow of air to said drive means to rotate said magnet in said clockwise direction, said first flow of air to said drive means being terminated before weighing said sample.

13. An apparatus, as set forth in claim 12, wherein said means for operating said drive means further includes a second air nozzle for providing a second flow of air to said drive means to rotate said magnet in said counterclockwise direction, said second flow of air to said drive means beginning before weighing said sample to stabilize said liquefied sample.

14. An apparatus, as set forth in claim 13, wherein said means for operating said drive means further includes a bracket attached to said frame of said electronic balance for mounting said first and second air nozzles.

15. A method for mixing a liquefied sample and weighing said sample, comprising the steps of:

providing a balance for weighing said sample;

removably mounting a magnetic mixer on said balance, said magnetic mixer having a drive means;

mounting a holder on said magnetic mixer;

placing a sample container on said holder, said sample container containing said liquefied sample and a magnet capable of clockwise and counterclockwise rotation under influence of said drive means;

operating said drive means and rotating said magnet thereby mixing said liquefied sample; and weighing said liquefied sample.

16. A method, as set forth in claim 15, wherein the step of operating said drive means includes providing a burst of air across an air gap to said drive means to rotate said magnet in said clockwise direction prior to weighing.

17. A method, as set forth in claim 15, wherein the step of operating said drive means includes providing a burst of air across an air gap to said drive means to rotate said magnet in said counterclockwise direction before weighing to stabilize said liquefied sample.

18. A method, as set forth in claim 15, wherein the step of operating said drive means includes:

providing a first flow of air across a first air gap to said drive means to rotate said magnet in said clockwise direction;

controlling said first flow of air to said drive means; and stopping said first flow of air to said drive means before weighing said sample.

19. A method, as set forth in claim 18, including providing a second flow of air across a second air gap to said drive means before weighing said liquefied sample to rotate said magnet in said counterclockwise direction and stabilizing said liquefied sample.

* * * * *